US006682014B1

(12) United States Patent
Hickey

(10) Patent No.: US 6,682,014 B1
(45) Date of Patent: Jan. 27, 2004

(54) DEVICE FOR EXERTING DRAG

(75) Inventor: Dennis J Hickey, Preston (GB)

(73) Assignee: BAE Systems plc, London (GB)

( * ) Notice: Subject to any disclaimer, the term of this patent is extended or adjusted under 35 U.S.C. 154(b) by 932 days.

(21) Appl. No.: 09/264,983

(22) Filed: Mar. 8, 1999

(30) Foreign Application Priority Data

Jun. 24, 1998 (GB) ..... 9813558

(51) Int. Cl.[7] ..... F42B 10/48

(52) U.S. Cl. ..... 244/3.27; 244/3.1; 244/3.24; 244/110 R; 244/113; 244/110 A

(58) Field of Search ..... 244/3.1, 3.24, 244/3.25–3.29, 3.3, 110 A, 110 H, 3.15, 3.2, 3.21, 110 R, 111, 112, 113, 3.22, 3.23

(56) References Cited

U.S. PATENT DOCUMENTS

| | | | | | |
|---|---|---|---|---|---|
| 3,598,345 | A | * | 8/1971 | Suter | 244/3.27 |
| 3,643,599 | A | * | 2/1972 | Hubich | 244/3.27 |
| 4,023,495 | A | * | 5/1977 | Fischer et al. | 244/3.29 |
| 4,162,053 | A | * | 7/1979 | Bjornson | 244/3.27 |
| 4,186,900 | A | * | 2/1980 | Loeb, Jr. | 244/113 |
| 4,295,617 | A | * | 10/1981 | Oswell | 244/3.29 |
| 4,674,705 | A | * | 6/1987 | Schleicher | 244/3.1 |
| 4,691,876 | A | * | 9/1987 | Kranz | 244/3.22 |
| 4,726,543 | A | * | 2/1988 | Stessen | 244/3.1 |
| 5,762,291 | A | | 6/1998 | Hollis et al. | |
| 5,816,531 | A | | 10/1998 | Hollis et al. | |
| 5,826,821 | A | | 10/1998 | Brandon et al. | |

FOREIGN PATENT DOCUMENTS

| | | | | |
|---|---|---|---|---|
| DE | 3414911 | * | 10/1985 | 244/3.21 |
| DE | 3925236 | * | 1/1991 | |
| WO | WO 98/01719 | | 1/1998 | |

* cited by examiner

*Primary Examiner*—Bernarr E. Gregory
(74) *Attorney, Agent, or Firm*—Nixon & Vanderhye P.C.

(57) ABSTRACT

A braking device for increasing the drag coefficient of an associated shell at a desired point while in flight is described. The device comprises: at least two braking vane means which, when released, extend substantially symmetrically into a surrounding airstream while said shell is in flight; retaining means for maintaining said at least two vane means in a retracted first position out of said airstream during an initial portion of said flight; releasing means to allow said at least two vanes to extend to a second position into said airstream at a desired point during said flight; said at least two vane means being extended by centrifugal force due to rotation of said associated shell about its axis; and, said at least two vane means further including co-operating means to ensure substantially symmetrical extension into said airstream.

33 Claims, 6 Drawing Sheets

DEVICE FOR EXERTING DRAG

The present invention relates to a device for exerting an aerodynamic drag force particularly, though not exclusively, on a ballistic shell whilst in flight.

It is advantageous to be able to improve the accuracy of ballistic shells fired from artillery pieces, for example, so that there is greater probability of hitting the intended target and lower probability of so-called collateral damage. The accuracy of such shells is much greater in the azimuth direction than in the longitudinal direction. Thus, an error zone of generally elliptical shape results where the long axis of the ellipse is in the longitudinal direction.

It is possible to alter the range of an artillery shell in flight by increasing its drag coefficient.

There has been a proposal for an artillery shell which has a course correction applied to it during flight. The shell is initially aimed to overshoot the target in the longitudinal direction and, whilst in flight, applying an aerodynamic brake to cause it to fall short of the original overshoot and much closer to the target than would otherwise have been the case. In this way it is thought that an error zone of significantly smaller area may be achieved.

However, there are problems associated with applying drag increasing brakes in that the brake must be applied as symmetrically as possible about the projectile axis so as to minimise the possibility of the spinning projectile becoming unstable in its trajectory.

SUMMARY OF THE INVENTION

The present invention seeks to make possible the provision of a device able to exert a substantially symmetrical drag force about the axis of spin of a projectile so as to increase its drag coefficient during flight.

According to a first aspect of the present invention there is provided a braking device for increasing the drag coefficient of an associated projectile whilst in flight, the device comprising: at least two braking vane means which, when released, extend substantially symmetrically into a surrounding airstream whilst said projectile is in flight; retaining means for maintaining said at least two vane means in a retracted first position out of said airstream during an initial portion of said flight; releasing means to allow said at least two vanes to extend to a second position into said airstream at a desired point during said flight; and, said at least two vane means further including co-operating means to ensure substantially symmetrical deployment into said airstream.

The braking vane means may be extensible by centrifugal force due to rotation of the associated projectile about its axis.

The device is preferably positioned on the nose of the projectile, which may be an artillery shell. Shells sometimes achieve supersonic speed in flight and positioning the device on the nose of the shell ensures that the braking vane means can extend into the surrounding airstream per se.

The device may be incorporated in a fuzing device positioned on a forward part of the shell and which fuzing device arms the shell and causes it to function when required.

The braking vane means may comprise braking vane members which extend substantially normal to the projectile axis into the surrounding airstream. The braking vane members may be pivoted about an inner end such that the centrifugal force generated by the projectile spinning about its axis causes the braking vane members to extend into the airstream.

Pivoted braking vane members are advantageous over vane members which are, for example, arranged to slide out into the airstream in guide members under the action of centrifugal force. Such sliding vanes have limited area available to extend into the airsteam due to the need to maintain adequate support of the vanes within the device to counteract the stresses imposed on them by the airstream. Furthermore, unless such sliding systems are very accurately made, they have a tendency to jam due to any misalignment which may be present. Thus, such sliding systems are inherently more expensive to make and less efficient in operation.

Pivoted vane members are advantageous under spin conditions because the distance between the pivot point and the centre of gravity of the vane members provides the mechanical advantage of allowing the pivoted vane members to deploy under less force than said sliding vanes, due to the turning moment generated during deployment. Pivot vane members also have the advantage of not requiring guide members, and so the misalignment of vane members and their guide members does not create a problem.

The retaining means may be a cover member which surrounds the braking vane members during an initial part of the flight so as to prevent them extending until desired.

The retaining means may be one or more straps.

The retaining means may be latches or hooks positioned on a support or base member in a way which prevents the braking vane members extending until desired.

The retaining means may be one or more pins which may extend into or through at least one braking vane member and a support or base member.

The releasing means may be explosive releasing means such as a small explosive charge or explosive cord for example, or may comprise a gas motor device. The releasing means may be detonated, for example, by a remote radio signal at the appropriate time so as to cause the retaining means to release the braking vane means to deploy by extending out into the airstream. The releasing means may cause fracture of the retaining means. The releasing means may alternatively cause the retaining means to move to a position which allows the braking vane means to deploy.

The releasing means may achieve its object by causing a retaining cover member to fracture and/or be jettisoned from the shell.

The releasing means may alternatively cause frangible fingers which interlock the braking vane means together to break and allow them to deploy through slots, for example, in a nose cover member.

The releasing means must be actuated at the appropriate time in order to provide the desired course correction. The releasing means may be activated as stated above by a remote radio signal. The device of the present invention itself may comprise a radio receiver device to receive the remote radio signal and to cause activation of the releasing means. Alternatively, any such radio receiver device may be associated with a fuzing device or with the shell itself, the radio receiver merely being operatively connected to the releasing means. The remote radio signal may come from a ground control station or a reconnaissance aircraft, for example.

Alternatively, the releasing means may be actuated by use of the Global Positioning System (GPS) as follows. At a given. point in its trajectory, an on-board processor compares the predicted position of the projectile with its actual position as determined through remotely accessing the GPS.

The processor then calculates the appropriate time delay at which the braking vane means need to be deployed, in order to provide the proper course correction, to bring the projectile on course for its intended target. The processor then sets an on-board timer accordingly, and the timer actuates the releasing means after the said appropriate time delay.

The braking vane means also employs co-operating means to ensure that, in use, they deploy substantially symmetrically about the axis of the shell. Such means may comprise control areas of the braking vane members, the control areas being arranged such that any asymmetric extension of radially adjacent vane members would result in mechanical interference between the control area of one vane member and an adjacent part of the other vane member. Thus, if one vane were to jam or stick in the closed or partially extended position, the control area of the adjacent vane would prevent the adjacent vane from extending further and substantially preventing asymmetrical deployment from occurring.

Alternatively, intermeshing gear teeth may be employed on curved portions of the braking vane members which ensure that they are deployed symmetrically.

The device may comprise pairs of braking vane members, each pair being disposed axially adjacent another.

The device may include means for preventing the braking vane members from extending further than desired into the airstream.

The device may comprise twin-bladed pairs of braking vane members where the twin blades are axially adjacent each other. Both blades may be pivoted about an inner end such that the centrifugal force generated by the associated shell spinning about its axis causes both blades of the braking vane members to extend into the airstream. One of the twin-blades may be prevented from extending as far into the airstream as the second of the twin-blades. The second of the twin-blades may be prevented from extending further than desired into the airstream by restraining means which may be carried by the first blade. The second of the twin-blades may overlie the first blade such that support is provided for the second blade by the first blade when both blades are fully extended. The second blade may advantageously provide an increased area extending into the airstream and therefore an increased drag coefficient for the shell in flight.

According to a second aspect of the present invention, there is provided a fuzing device incorporating the braking device of the first aspect of the present invention.

According to a third aspect of the present invention, there is provided a projectile incorporating the braking device of the first aspect or the fuzing device of the second aspect of the present invention.

BRIEF DESCRIPTION OF THE DRAWINGS

In order that the present invention may be more fully understood, examples will now be described by way of illustration only with reference to the accompanying drawings, of which.

Figure 1:
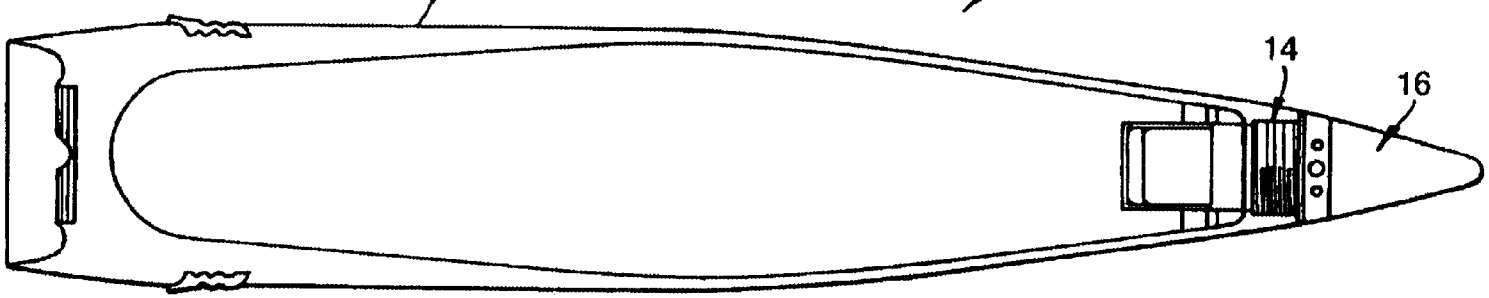
FIG. 1 shows a general cross sectional view of a typical shell.

Referring now to the drawings and where the same features are denoted by common reference numerals.

DETAILED DESCRIPTION OF THE INVENTION

FIG. 1 shows a cross section through a shell indicated generally at 10 and incorporating a braking device according to the present invention. The shell includes a body casing 12, a fuzing device 14 and a braking device 16 according to the present invention at the nose end of the shell. The braking device 16 as shown in the schematic cross section of FIG. 2 comprises a base member 20 which is used to attach the device 16 to the fuze 14 which has a central column 15 onto which the base plate 20 is fixed. The base plate 20 provides support for pivots 46, 48 for the rearward pair of braking vane members 22. Support for pivots 36, 38 for the forward pair 24 of braking vane members is provided by a second support plate 39 attached to the central column 15. A cover member 26 provides an aerodynamic nose to the shell 10 and also constitutes the retaining means which retain and prevent the two pairs of braking vane members 22, 24 from deploying until desired. The nose portion 28 of the cover 26 houses a small explosive charge 30 which is detonated by an electrical impulse via a wire 32 to an igniter 34 in the charge 30. The electrical impulse comes from radio receiver means (not shown) associated with the fuzing device 14, the radio receiver means being itself activated by a remote radio signal. The cover 26 may be made from a plastics material and may have various formations (not shown) such as grooves for example, which cause it to fracture along preferred paths to achieve a desired mode of fracture and separation from the shell whilst in flight.

Figure 3:
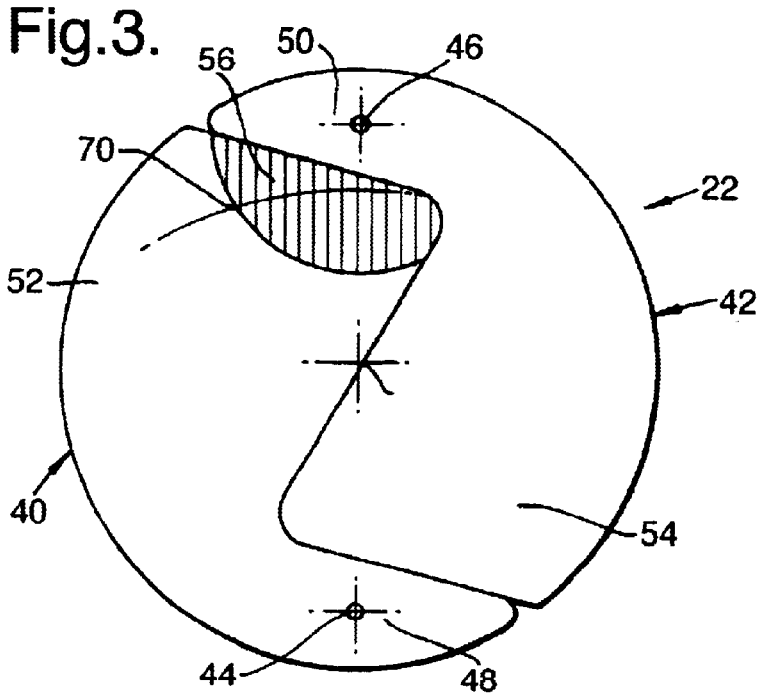
FIG. 3 shows an explanatory view of means to ensure symmetrical deployment of braking vane means.
Figure 4:
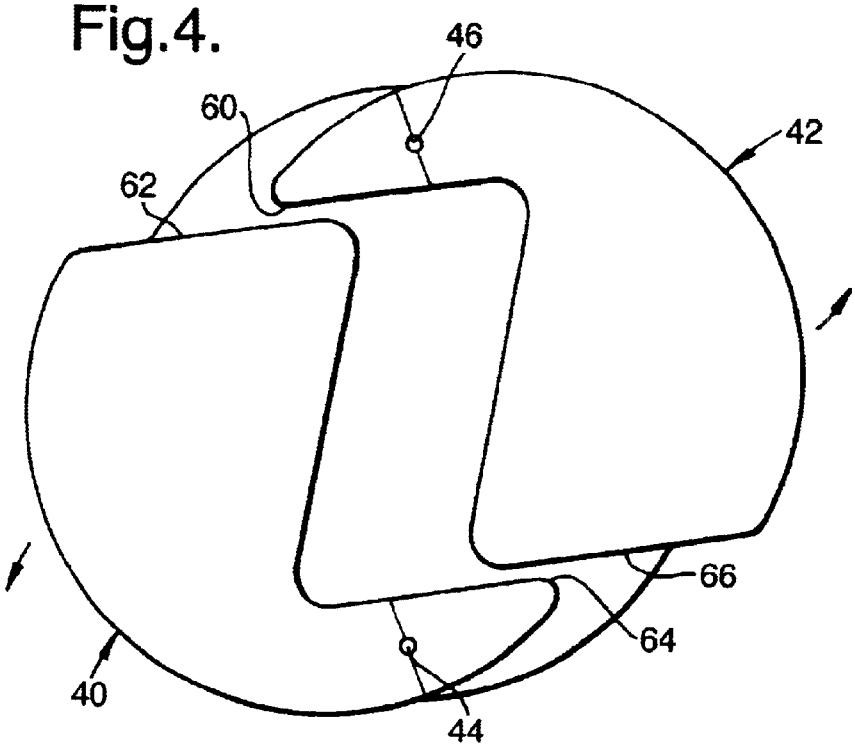
FIG. 4 shows a front view along a shell axis of the braking vanes of FIG. 3 deploying normally.
Figure 5:
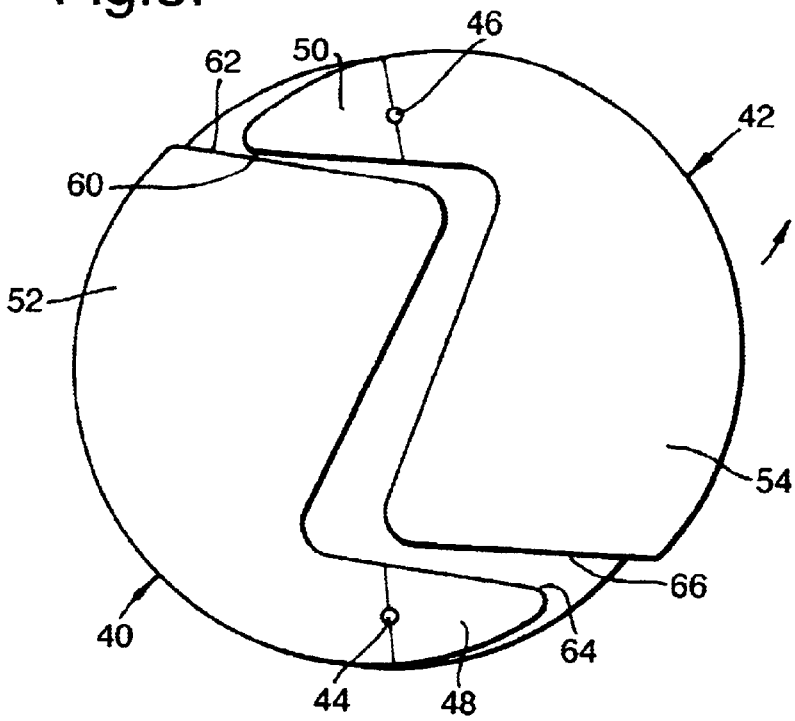
FIG. 5 shows a view similar to that of FIG. 4 but where one vane has failed to deploy normally.

Pair 22 of braking vane members is shown in FIG. 3, pair 24 is similar to pair 22 but displaced by 90° from pair 22 about the shell axis 18. Each pair of braking vane members 22, 24 comprises two distinct braking vane members 40, 42, each member having a respective pivot 44, 46 about which it is able to rotate under the influence of centrifugal force from the spinning shell whilst in flight and when the retaining cover member 26 is jettisoned by the explosive charge 30. Each member has a control area 48, 50 on the opposite side of the pivots 44, 46 to the drag or braking area 52, 54 of each member. The effect of the control area is to create a potential overlapping area indicated by the shaded area at 56. However, since the two members 40, 42 lie in the same plane and are of significant thickness, it is not possible for them to overlap. Therefore, it is only possible for both braking vane members to deploy simultaneously. As shown in FIG. 5, if braking vane member 40, for example, jams for any reason, the tip 60 of control area 50 abuts the edge 62 of braking or drag area 52 and prevents braking vane member 42 from extending further thus, maintaining a substantially symmetrical drag force about the shell axis 18. Similarly, if member 42 were to jam, tip 64 of control area 48 would abut edge 66 of braking or drag area 54 of member 42 and prevent member 40 from deploying further. When both members 40, 42 deploy normally as shown in FIG. 4, the tips 60, 64 and edges 62, 66 move along each other to give substantially equal and simultaneous deployment of the braking vane members thus exerting and maintaining a symmetrical force about the shell axis 18.

Figure 6:
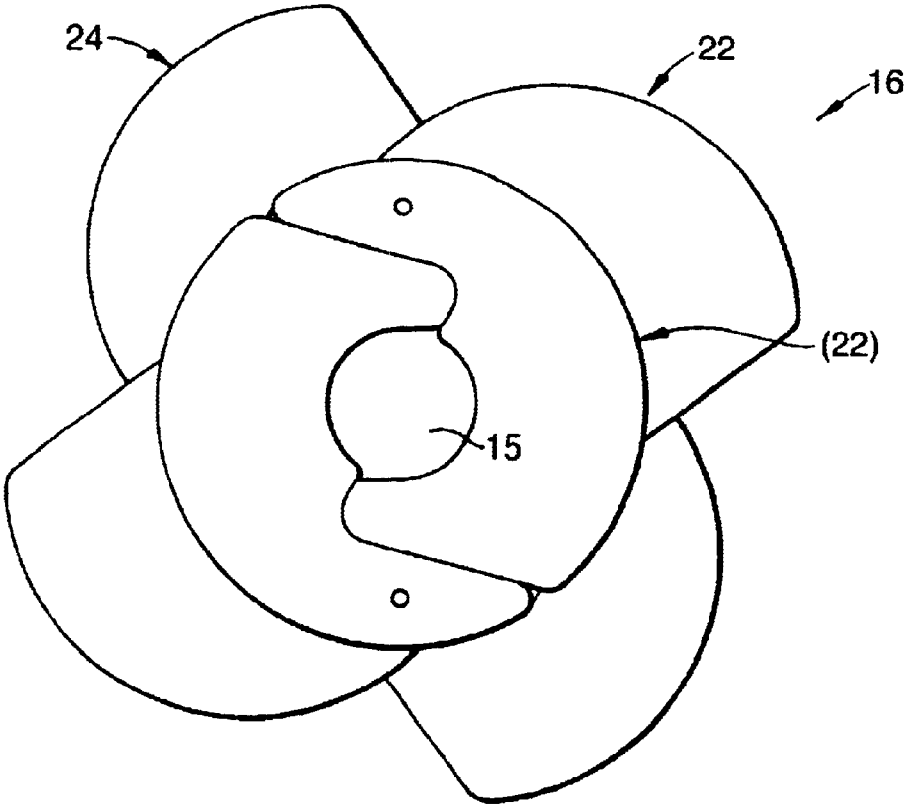
FIG. 6 which shows a front view along a shell axis of a device having two pairs of braking vane members.

FIG. 6 shows a schematic front view of the device 16. Pairs of braking vane members 22, 24 are shown deployed, together with pair 22 also shown still in the retracted position (22) in order to show the difference between the extended and retracted positions of the vane members.

In FIG. 3, a point indicated at 70 is where the tip 60 eventually clears the path of the edge 62 during the course of deployment of the braking vane members. Similarly, there will be a corresponding point (not shown) where the tip 64 clears the path of edge 66. Once the tips 60, 64 have moved past these points, neither member 40 nor member 42 can exert any influence over the other with regard to deployment thereof. However, this is not important since it is in the initial phases of braking vane member deployment that jamming or sticking is most likely to occur.

Figure 7A:
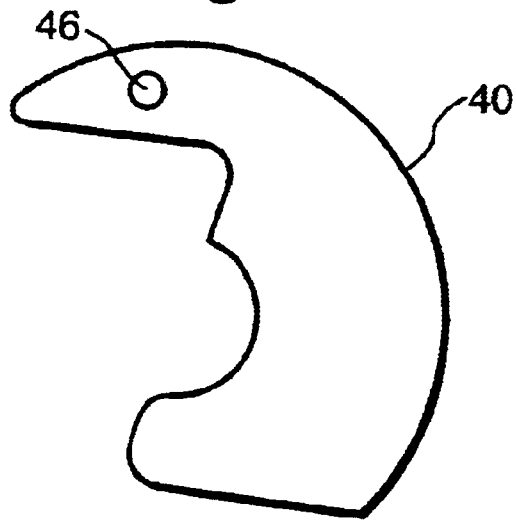
FIG. 7*a* shows the form of single-blade braking vane member which is used in FIG. 6, and can be used in place of the vanes shown in FIGS. 1–4.

FIG. 7*a* shows a single blade braking vane member 40 having a pivot 46 about which it is able to rotate under the influence of centrifugal force from the spinning shell whilst in flight. The member 40 is able to be positioned about a central column 15 (shown in FIG. 6). Support for the pivot is provided by the base plate 20 or the support plate 39 (both shown in FIG. 2). The member 40 is profiled to interact with other braking vane members as described in FIG. 3.

Figure 7B:
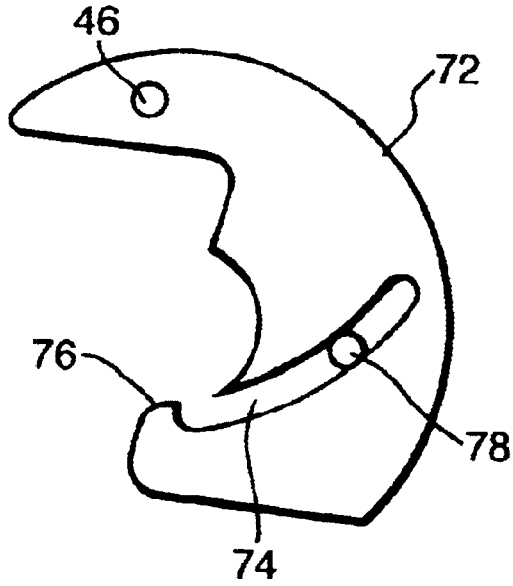
FIG. 7*b* shows an alternative form of single-blade braking vane member together with limiting means for preventing the braking vane member from extending further than desired into the airstream.

FIG. 7*b* shows a single-blade braking vane member 72 similar to member 40 (shown in FIG. 7*a*) having a pivot 46 but also a having a groove 74 and a lip 76. A pivot or pin 78 fixed to an axially adjacent plate such as the base plate 20 or support plate 39 (both shown in FIG. 2) limits rotational movement of the braking vane member 72 about the pivot 46. As the member 72 moves into the airstream the groove 74 moves with it, the member 72 being restrained when the lip 76 at the end of the groove 74 comes against the pin 78.

Figure 2:
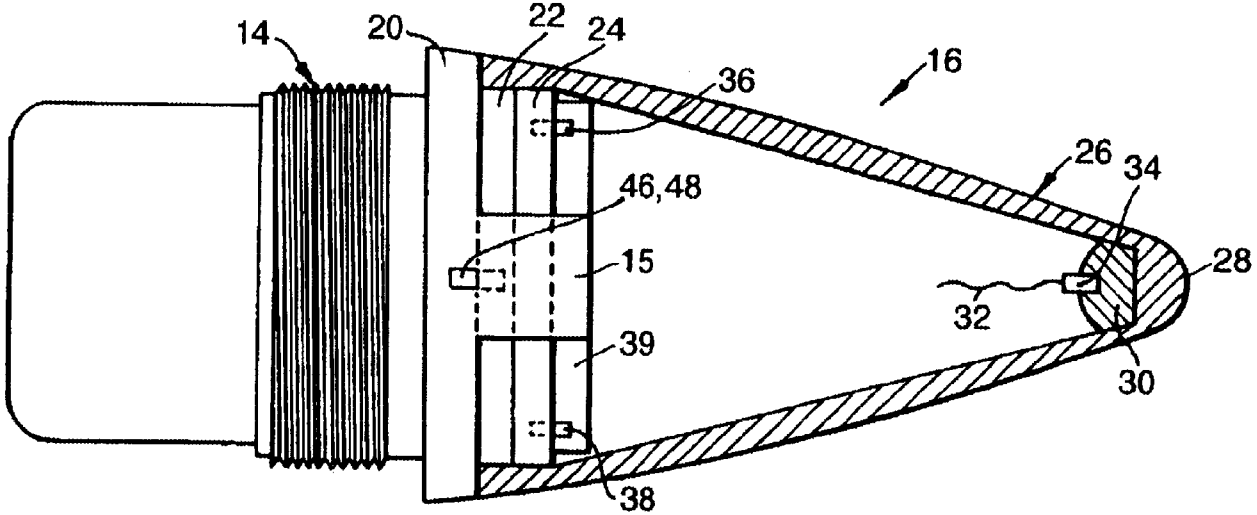
FIG. 2 shows a schematic cross section through a device according to the present invention.
Figure 8A:
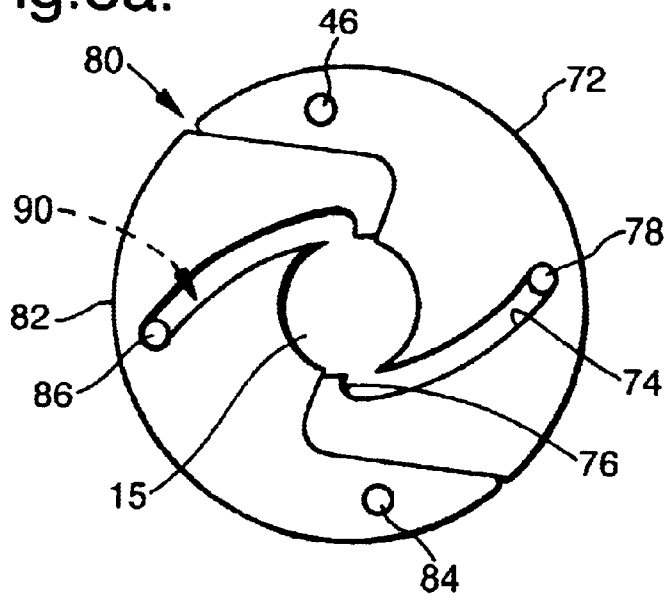
FIG. 8*a* shows a front view along a projectile axis of a device having two pairs of single-blade braking vanes, each being of the kind shown in FIG. 7*b*.

FIG. 8*a* shows one pair 80 of single-blade braking vane members axially adjacent to another pair 90. The single-blade braking vane members 72 and 82 are pivoted at points 46 and 84 respectively, the pivots 46 and 84 being fixed to a base plate 20 or support plate 39 (as shown in FIG. 2). Member 72 is prevented from extending too far into the airstream by the pin 78 meeting the lip 76 of the groove 74. Members 72 and 82 are only able to deploy symmetrically, as described in FIG. 3.

Figure 8B:
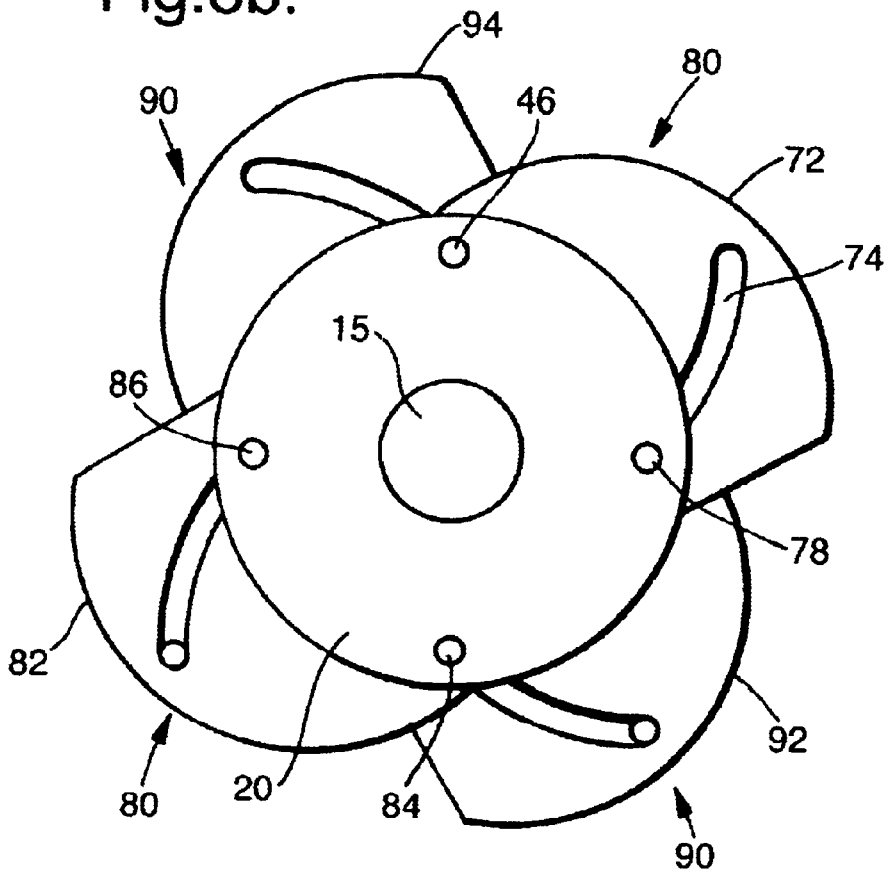
FIG. 8*b* shows a front view along a projectile axis of the device shown in FIG. 8*a,* wherein the two pairs of single-blade braking vanes are fully deployed.

FIG. 8*b* shows both pairs 80 and 90 of single blade braking vane members fully deployed. Member 72 has rotated about pivot 46 and is constrained from rotating further by the lip 76 of the groove 74 reaching the pin 78. The pins 78 and 86, which restrict the movement of the members 72 and 82 as previously described, also act as pivots for the pair of braking vane members 90 axially adjacent to the pair 80. Member 94 rotates about the pivot 86 and member 92 rotates about the pivot 78. Similarly, the pivots 46 and 84, around which the members 72 and 82 rotate, also act as the pins which constrain the rotation of the members 94 and 92 respectively. The pivots 46, 78, 84 and 86 are fixed to a base plate 20 and a support plate 39 as shown in FIG. 2.

Figure 9A:
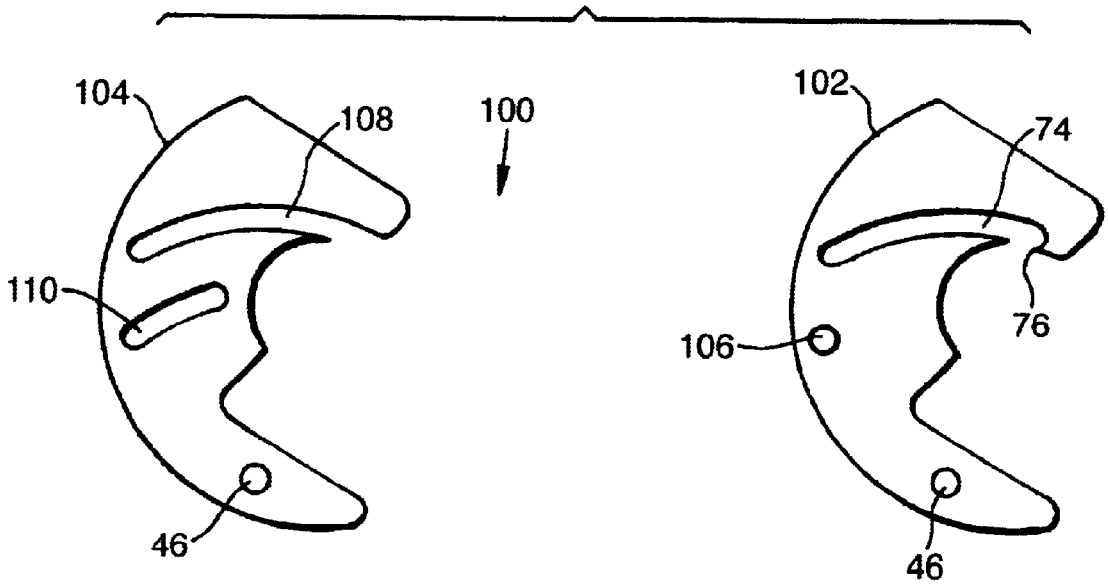
FIG. 9*a* shows the two blades of a twin-blade braking vane member which can be used in place of the single-blade versions shown in FIGS. 7*a,* 7*b,* 8*a* and 8*b*.

FIG. 9*a* shows two blades 102 and 104 which together form a twin-blade braking vane assembly 100. The blade 102 is similar to the member 72 shown in FIG. 7*b*. The blade 102 rotates about a pivot 46 which is fixed to a base plate 20 or support plate 39 (shown in FIG. 2). This rotational movement is limited by the lip 76 of the groove 74 reaching a pivot or pin such as 78 (shown in FIG. 7*b*), which is fixed to a base plate 20 or a support plate 39 (shown in FIG. 2). The blade 102 also has fixed to it a pin 106. The blade 104 is designed to fit axially adjacent to the blade 102 when not deployed such that both blades 102 and 104 are able to rotate about the pivot 46. The blade 104 has a groove 108 which is axially adjacent to the groove 74 when the blades 102 and 104 are not deployed. The groove 108 does not have a lip. The blade 104 has a second closed groove 110 which receives the pin 106 fixed to the blade 102. The movement of the blade 104 relative to the blade 102 is restricted by the pin 106 coming against the ends of the groove 110.

Figure 9B:
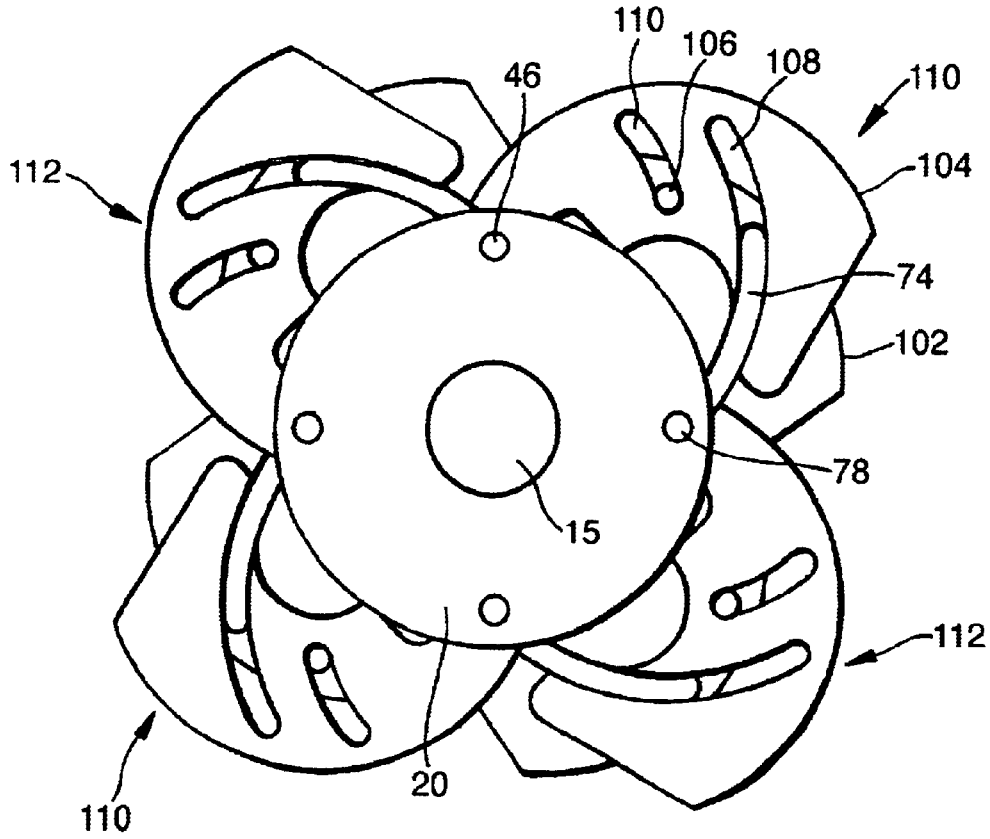
FIG. 9*b* shows a front view along a projectile axis of a device having two pairs of twin-blade braking vanes as shown in FIG. 9*a,* wherein the vanes are fully deployed.

FIG. 9*b* shows two axially adjacent pairs of twin-blade braking vane assemblies 110 and 112 fully deployed. Blades 102 and 104 rotate about the pivot 46 which is fixed to a base plate or support member 20. Blade 102 is deployed as far as possible and is restrained from further rotation by the pivot 78 meeting the lip 76 (shown in FIG. 9*a*) of the groove 74. The blade 104 does not have a lip on the groove 108 and is therefore able to rotate further into the airstream than the blade 102. Blade 104 is prevented from rotating further than desired by the pin 106 fixed to the blade 102 within the groove 110. Blade 102 advantageously provides support to blade 104, which in the deployed position is otherwise only supported by the pivot 46. This twin-blade arrangement shown in FIG. 9*b* provides a larger braking surface area than that of the single-blade arrangement shown in FIG. 8*b*.

What is claimed is:

1. A braking device for increasing the drag coefficient of an associated projectile whilst in flight, the device comprising: at least two braking vane means which, when released, extend substantially symmetrically into a surrounding airstream whilst said projectile is in flight; retaining means for maintaining said at least two vane means in a retracted first position out of said airstream during an initial portion of said flight; releasing means to allow said at least two vanes to extend to a second position into said airstream at a desired point during said flight; and, said at least two vane means further including co-operating means to ensure substantially symmetrical deployment into said airstream.

2. A device according to claim 1 wherein said at least two vane means are extensible by centrifugal force due to rotation of said associated projectile about its axis.

3. A device according to claim 1 wherein said device is positioned on a forward part of said associated projectile.

4. A device according to claim 1 wherein the device is incorporated in a fuzing device positioned on a forward part of an artillery shell.

5. A device according to claim 1 wherein the braking vane means comprise braking vane members which extend substantially normal to the projectile axis into the surrounding airstream.

6. A device according to claim 5 wherein the braking vane members are pivoted about an inner end such that the centrifugal force generated by the associated projectile spinning about its axis can cause the braking vane members to extend into the airstream.

7. A device according to claim 5 wherein said braking device includes means for preventing said braking vane members from extending further than desired into the airstream.

8. A device according to claim 5 wherein each braking vane member comprises a twin-bladed braking vane and the twin-blades of each of said braking vane members are axially adjacent each other.

9. A device according to claim 8 wherein said twin-blades are each pivoted about an inner end such that in use the centrifugal force generated by the associated projectile spinning about its axis causes both of said twin-blades to extend into the airstream.

10. A device according to claim 9 wherein there is provided means for preventing a first one of said twin-blades from extending as far as a second one of said twin-blades into the airstream.

11. A device according to claim 10 wherein the said second of said twin-blades is restrained from extending further than desired into the airstream by restraining means carried by the first of said twin-blades.

12. A device according to claim 8 wherein the said second of said twin-blades overlies the first of said twin-blades when both of said twin blades are fully extended, such that support is provided for the said second blade by the said first blade.

13. A device according to claim 1 wherein the retaining means is a cover member which surrounds the braking vane means during an initial part of said flight.

14. A device according to claim 1 wherein the retaining means is a strap.

15. A device according to claim 1 wherein the retaining means is a latch or a hook.

16. A device according to claim 1 wherein the retaining means is a pin.

17. A device according to claim 16 wherein the pin extends into or through at least one braking vane member and a support or base member.

18. A device according to claim 1 wherein the releasing means is explosive releasing means.

19. A device according to claim 1 wherein the releasing means is a gas motor device.

20. A device according to claim 1 wherein said releasing means is capable of being activated by a remote radio signal.

21. A device according to claim 1 wherein in use said releasing means causes fracture of said retaining means.

22. A device according to claim 1 wherein in use said releasing means permits said retaining means to move to a position which allows said braking vane means to deploy.

23. A device according to claim 1 wherein the retaining means comprise frangible fingers which join the braking vane means together.

24. A device according to claim 1 having a radio receiver device incorporated therein.

25. A device according to claim 24 wherein said radio receiver is operatively connected to the releasing means.

26. A device according to claim 1 wherein the releasing means are actuable by use of the Global Positioning System.

27. A device according to claim 26 having an on-board processor for comparing the predicted position of the projectile with its actual position as determined through remotely accessing the Global Positioning System and then calculating the requisite time delay to deployment of the braking vane means to provide course correction.

28. A device according to claim 1 wherein the braking vane means include control areas of the braking vane members, said control areas being arranged such that any asymmetric extension of radially adjacent vane members would result in mechanical interference between the control area of one vane member and an adjacent part of the other vane member.

29. A device according to claim 1 wherein the means for ensuring symmetrical employment are intermeshing gear teeth.

30. A device according to claim 1 wherein the device comprises pairs of braking vane members each pair being disposed axially adjacent another.

31. A device according to claim 1 the device comprising pairs of braking vane means, each pair being disposed axially adjacent another.

32. A fuzing device incorporating the braking device of claim 1.

33. A projectile incorporating the braking device of claim 1.

* * * * *